US006976331B2

(12) United States Patent
Fast

(10) Patent No.: US 6,976,331 B2
(45) Date of Patent: Dec. 20, 2005

(54) SIGN HOLDER

(75) Inventor: Jacob Fast, Boca Raton, FL (US)

(73) Assignee: Fast Industries, Ltd, Fort Lauderdale, FL (US)

( * ) Notice: Subject to any disclaimer, the term of this patent is extended or adjusted under 35 U.S.C. 154(b) by 0 days.

(21) Appl. No.: 10/627,862

(22) Filed: Jul. 28, 2003

(65) Prior Publication Data

US 2004/0055983 A1 Mar. 25, 2004

Related U.S. Application Data

(60) Provisional application No. 60/412,805, filed on Sep. 24, 2002.

(51) Int. Cl.[7] ..... G09F 3/18
(52) U.S. Cl. ..... 40/661.03
(58) Field of Search ..... 40/661.03, 642.02, 40/661.08, 649, 661.06

(56) References Cited

U.S. PATENT DOCUMENTS 4,485,575 A 12/1984 Fast
4,531,313 A 7/1985 Fast
4,557,064 A * 12/1985 Thompson ..... 40/661.03
4,704,813 A 11/1987 Fast
4,713,899 A 12/1987 Fast
4,917,342 A 4/1990 Fast
4,955,182 A 9/1990 Newman
4,995,182 A 2/1991 Fast
5,458,307 A 10/1995 Gebka
5,488,793 A 2/1996 Gebka et al.
5,515,632 A 5/1996 Gebka et al.
5,682,698 A 11/1997 Bevins
5,899,011 A 5/1999 Brinkman
6,026,603 A * 2/2000 Kump et al. ..... 40/661.03
6,105,295 A 8/2000 Brinkman et al.
6,163,996 A 12/2000 Gebka
6,568,112 B2 * 5/2003 Lowry et al. ..... 40/661.03

* cited by examiner

*Primary Examiner*—S. Joseph Morano
*Assistant Examiner*—Robert J. McCarry, Jr.
(74) *Attorney, Agent, or Firm*—Jacobson Holman PLLC

(57) ABSTRACT

A sign holder for attachment to a merchandise display shelf including a sign-receiving element and a mounting element in the form of an inverted, J-shaped, member with an elongated mounting panel and a short reverted portion at its upper end. The mounting panel may be engaged in the pocket of a label holder carried by said merchandise display shelf. Alternatively, the mounting panel may be engaged directly in a C-channel carried by a front lip on the merchandise display shelf or the front of a label holder having sign-receiving channels defined on the front face of its cover member. The reverted portion of the mounting element is connected to the sign-receiving element by a resilient connector such as a bead of flexible material to permit slight movement of the sign-receiving element in the event it is impacted when merchandise is placed on, or removed from, a lower shelf.

2 Claims, 3 Drawing Sheets

SIGN HOLDER

This is a complete application claiming benefit of provisional application Ser. No. 60/412,805 filed Sep. 24, 2002.

BACKGROUND OF THE INVENTION

1. Field of the Invention

This invention relates to merchandising aids, and relates more particularly to the manner and means by which a sign holder is secured to a merchandising shelf to highlight certain information about a particular product or group of products carried by the shelf at a given location.

2. Description of the Related Art

Shelves with "C-channels" along the front edge are commonly found in merchandise outlets such as supermarkets, pharmacies and the like, the C-channel being formed with spaced upper and lower opposed lips to provide a convenient means for mounting many different kinds of fit-in articles, such as labels, signs or sign holder which provide information relating to the merchandise displayed on the shelf. While adhesive-backed labels can be secured directly to such a surface, removing such adhesive-backed labels is time consuming and difficult, leaving an unsightly residue build-up which is resistant to cleaning. Generally, non-adhesive paper or plastic labels are preferred since they can easily be replaced if they become damaged or the product information changes. Therefore, label holders have been provided which commonly have a back or body panel attached in some fashion to the supporting surface, with a transparent cover member flexibly secured along one mating edge to the body panel to define a pocket between the front surface of the body panel and the rear surface of the cover member for removable reception of one or more such information-containing labels.

Label holders are generally provided in elongated sections, perhaps 4' or more in width, and may be secured by adhesive strips or the like to any supporting surface such as the side of a shelving or warehouse unit. However, most applications for such label holders are directly on the front flange or in the C-channel of the front edge of a product display shelf. Various prior art embodiments of such label holders can be seen in U.S. Pat. Nos. 4,713,899, 5,458,307, 5,488,793, 5,515,632, 5,682,698, 5,899,011 and 6,105,295, the disclosures of which are incorporated herein in their entireties by reference.

Oftentimes, in addition to the information provided by the product labels, it is desired to highlight certain information about a particular product or group of products by displaying an enlarged "flag" or sign on the shelf, depending from the portion of the shelf carrying such products, or extending into the aisle at such a location. Different forms of "sign holders" are also well known in the merchandising art, examples of which can be seen in the aforementioned U.S. Pat. No. 5,488,793, as well as U.S. Pat. Nos. 4,485,575, 4,531,313, 4,625,441, 4,704,813, 4,917,342, 4,995,182, 5,682,698, and 6,163,996, the disclosures of which are also incorporated herein in their entireties by reference.

Separate sign holders can simply be positioned on the shelf itself, or juxtaposed to the shelf in the aisle. Yet, such an arrangement may not be stable, can waste valuable product display space, and can even cause damage to consumers. For that reason, as seen in some of the aforementioned patents, such sign holders may be designed to be supported partially or entirely in the same C-channels as the label holders.

While constructions of this nature are convenient for many applications, significant difficulties are encountered when it is necessary to insert new labels or to remove or replace labels already carried in the underlying label holder. In order to access the label holder pocket, any and all sign holders secured in front of and, therefore, overlying the label holder must first be removed, and subsequently replaced. This is time consuming, labor intensive, and obviously inefficient, particularly when using elongated label holders that may have multiple sign holders engaged along their length.

U.S. Pat. No. 6,568,112 issued May 27, 2003 (the '112 patent), the subject matter of which is also incorporated herein in its entirety by reference, provides a combination label/sign holder wherein the sign holders are carried by, and move with, the cover member and do not interfere with access to the label holder pocket so that labels can be selectively inserted and removed from the label holder pocket without removing any of the sign holders associated with related products. More specifically, in the '112 patent, the front surface of the cover member of the label holder is provided with a pair of sign holder-receiving lip members which can snappingly receive edge portions of a resilient plastic or metal sign holder such as seen in aforementioned U.S. Pat. No. 5,488,793, or the engaging portions of a depending sign holder of the type seen in aforementioned U.S. Pat. Nos. 5,682,698 (the '698 patent) and 6,163,996 (the '996 patent), or other such commercially available sign holders. The combination label/sign holder of the '112 patent also includes a locking construction to secure paper or the like labels in the pocket, with a ledge or other finger-engaging element adapted to facilitate opening the label holder for insertion or removal of labels from the pocket as seen particularly in aforementioned U.S. Pat. No. 5,515,632.

Some merchandising shelves do not have integral C-channels and have only a downwardly depending or downwardly and forwardly angled front edge or lip terminating in a rearwardly-directed lower flange. Attachment of a label holder or a combination label/sign holder to a merchandise shelf devoid of an integral C-channel is problematic. While label or label/sign holders can be adhesively secured to the depending lip on shelves of this nature, moving or replacing such elements, as with the adhesively-backed labels themselves, is difficult, time consuming and leaves an unsightly residue that is resistant to cleaning. Attempts to avoid the adhesive attachment with various elements fixing the lower portion of the label holder to or around the rearwardly extending flange on the bottom of the shelf have been generally unsuccessful because they cannot retain the body panel in position against the front edge of the shelf when the cover member is tipped forwardly to insert or remove a label from the pocket. Pending U.S. application Ser. No. 10/222,775 filed Aug. 19, 2002 (the '775 application), the subject matter of which is incorporated herein in its entirety by reference, discloses several embodiments of a label holder and an adaptor therefore designed to facilitate attachment of same to a merchandise shelf devoid of a C-channel, and provisional U.S. application Ser. No. 60/411,407 filed Sep. 18, 2002 (the '407 application), the subject matter of which is also incorporated herein in its entirety by reference, discloses a similar label holder wherein the "adaptor" portion is actually a pierceable, thin-film element integral with the body panel of the label holder.

One problem associated, particularly with sign holders designed to carry a "flag" or sign displaying special information to the consumer such as identifying a "sale" item or the like, whether mounted directly in a C-channel, or the sign holder portion of a combination label and sign holder such as seen in the '112 patent, is the possibility that such devices can be damaged or even become dislodged from their support mechanism when an item is removed from a shelf juxtaposed to the sign holder. This is particularly true of a sign holder such as seen in the aforementioned '698 patent wherein a significant portion of the sign holder depends downwardly to a level below the C-channel or front flange of a shelf where it may be engaged by a consumer reaching for a product on a lower shelf, or removing the product from the shelf. Sign holders are available in which a small connecting section of a flexible or resilient polymer such as polyvinyl chloride is used to secure the same to a support mechanism to provide some resilience to the sign holder, minimizing the likelihood of damage and/or disengagement of the sign holder from its support. However, no product is currently available that provides such flexibility and, additionally, includes a supporting mechanism having the versatility to be either engaged in the pocket formed between the main body member and the transparent cover of a label holder or, alternatively, directly supported in a C-channel or the sign holder portion of a combination label/sign holder such as seen in the '112 patent. Heretofore, therefore, it has been necessary to stock a significant variety of sign holders to provide for diverse applications.

SUMMARY OF THE INVENTION

A primary object of this invention is the provision of a sign holder designed to be supported in the pocket of a standard paper label holder or secured directly in a C-channel of the type formed integrally with the front lip of a merchandise shelf or of the type carried by the cover of a combination label/sign holder.

A further object of this invention is the provision of a sign holder having a flexible or resilient interconnection between a support portion and a sign holder portion to permit the sign holder portion to flex relative to the support portion without damaging or disengaging the same in the event the label holder portion is pushed inwardly or outwardly at its upper or lower extremity.

Still another object of this invention is to provide a sign holder of the type described which is simple and inexpensive to manufacture and use, yet sturdy and durable to facilitate reuse or movement to another location as necessary.

Other and further objects, features and advantages of the invention will become apparent from the ensuing description and claims taken in conjunction with the attached drawings.

BRIEF DESCRIPTION OF THE DRAWINGS

Like reference characters refer to like parts throughout the several views of the drawings.

DESCRIPTION OF THE PREFERRED EMBODIMENTS

While the instant inventive concepts are designed primarily to support a "sign" holder, that is, a holder of limited width adapted to carry a "flag" or the like displaying special information to the consumer such as identifying a "sale" item or the like, the same concepts can be applied to a label holder or a combination label/sign holder which extends laterally over a significant portion of a shelf and carries multiple labels, signs or the like providing consumer and inventory information relating to items on different parts of the shelf surface. However, since the primary use of the device of this invention is to carry a sign, rather than a multiplicity of labels or the like, further description herein will be directed to that application. However, it should be understood that, except as otherwise specifically set forth, the term "sign holder" as used herein and in the appended claims is intended to cover a sign holder, a label holder and/or a combination label/sign holder as discussed above with respect to the various copending applications and prior art patents.

Figure 1:
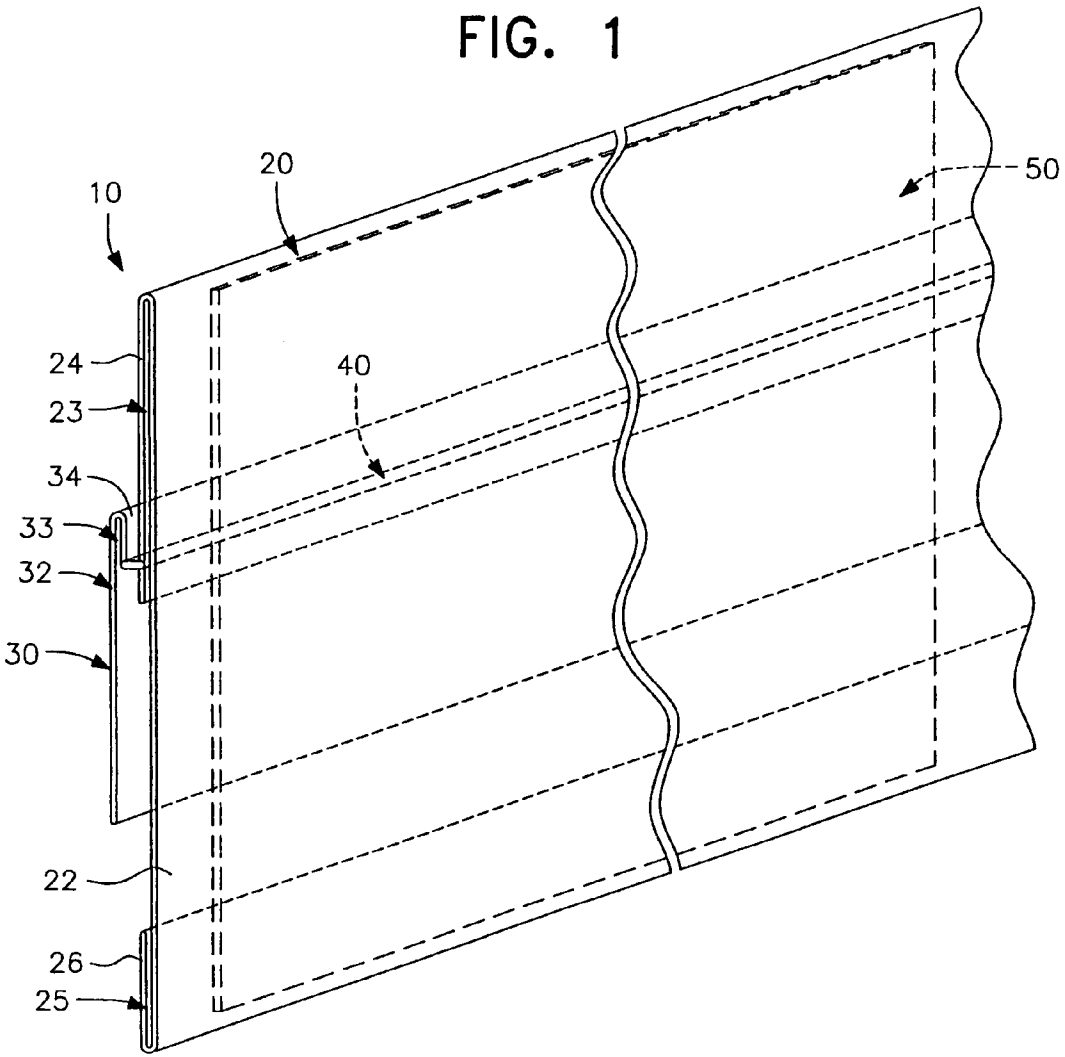
FIG. 1 is a fragmentary perspective view of one embodiment of a sign holder according to the instant inventive concepts, partially broken away for illustrative convenience, and with hidden parts shown in dotted lines.

Referring now to FIG. 1, one preferred embodiment of sign holder according to the instant inventive concepts is designated generally by the reference numeral 10 and comprises a sign holder section 20 and a support section 30 interconnected by a bead of resilient material 40. The sign holder section 20 and the support section 30 can be formed of any conventional polymeric material although, in order to enable a sign or the like 50 carried by the sign holder section 20 to be viewed by passersby, is evident that, at least the front face 22 of the sign holder section 20, must be transparent. Generally speaking, the sign holder section 20 and the support section 30 are formed of relatively rigid plastic materials while the connecting bead 40 is of a more resilient, yet structurally sound, plastics material adapted to enable the sign holder section 20 to flex slightly relative to the support section 30 as necessary in use and to then return the sign holder section 20 to its generally vertically extending relationship relative to the merchandise supporting surface of an associated shelf.

The method of manufacturing the sign holder 10, as well as the particular plastics materials utilized for each of the sections thereof, are not critical to the instant inventive concepts. Generally, however, it is preferred to form the sign holder 10 as a tri-extrusion using techniques well known to those with ordinary skill in this art.

In the embodiment shown in FIG. 1, the sign holder section 20 is almost identical to the sign holder seen in the '698 patent, except that the sign holder of the '698 patent, being formed of a single material, is usually heat-folded from a sheet of plastics rather than extruded. Regardless, the sign holder section 20 includes the front face 22, generally transparent as indicated above, with a pair of reverted flaps 24,26 which may be of different heights as described in the '698 patent, or for the purposes of this invention, may be of the same height. A pocket 23 is formed between the front surface of the flap 24 and the upper portion of the rear surface of the front face 22, and a pocket 25 is formed between the front surface of the flap 26, and the lower portion of the rear surface of the front face 22 to retain the upper and lower edge portions of a sign 50 in an obvious manner.

The support section 30 is formed in cross-section like a candy cane having an elongated main support element 32 curved at its top to form a short downwardly depending lip 34 between the facing surfaces of which is defined a pocket 33. In this embodiment, the connecting bead 40 secures the lower portion of the front surface of the lip 34 of the support section 30 to the rear surface of the flap 24 of the sign holder section 20. The exact location of the connecting bead 34 is not critical although it should generally be located above the midpoint of the sign holder 10 to facilitate the flexing action since the sign holder section is normally engaged adjacent its lower edge in use.

While the sign holder section 20 of the embodiment of FIG. 1 has been shown as similar to the sign holder of the '698 patent, it is to be understood that other sign or label holder devices of the type seen in the many of the above-identified patents, can be substituted therefor without departing from the instant inventive concepts.

Figure 2:
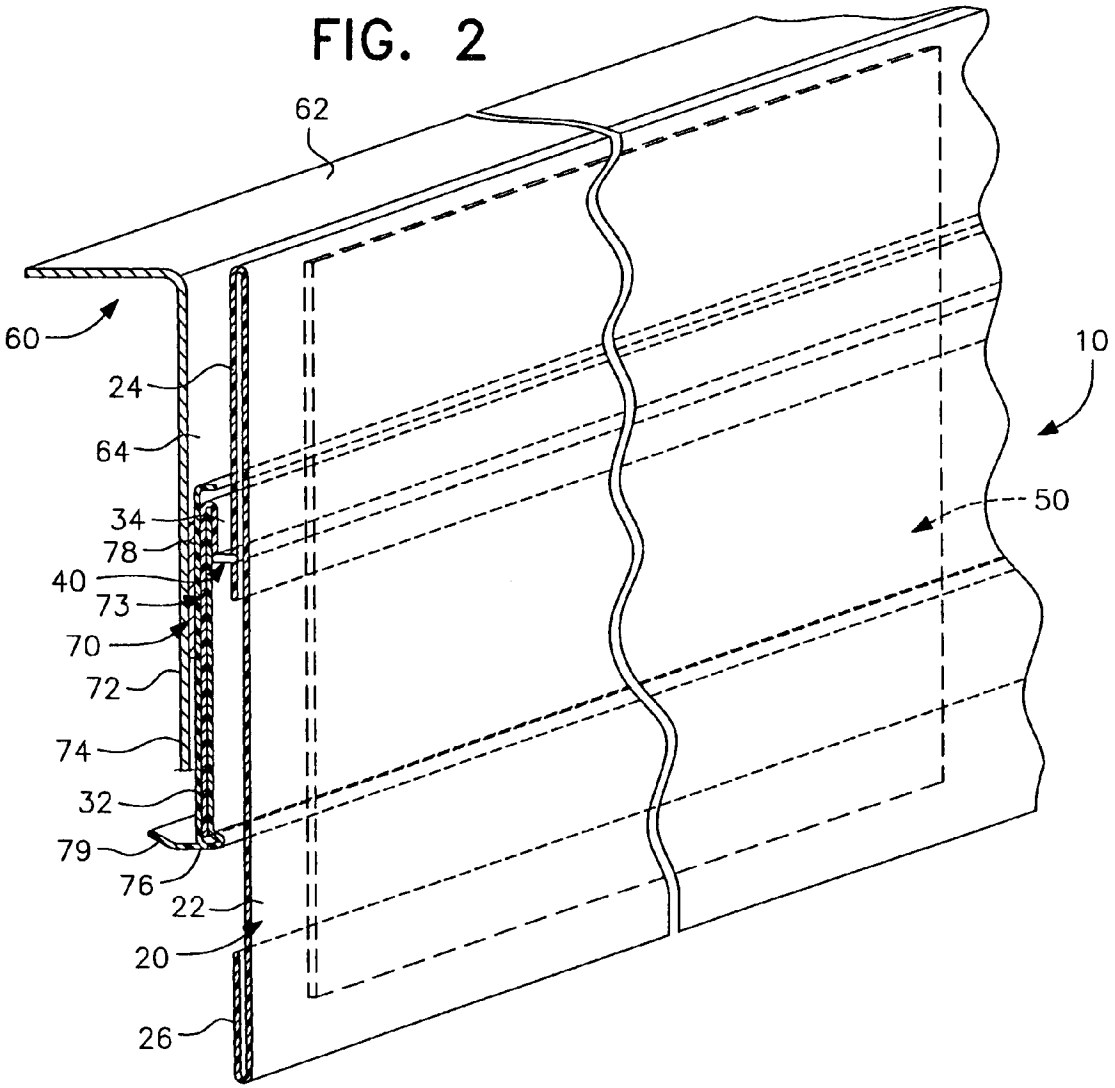
FIG. 2 is a cross-sectional perspective view of the sign holder of FIG. 1 carried by a label holder attached to the front lip of a merchandise shelf.

With reference to FIG. 2, one way in which the sign holder 10 of this invention can be used is illustrated. In this instance, a shelf 60 having a merchandise-supporting, generally horizontally extending surface 62 and a depending front flange or lip 64, supports a label holder 70 comprising a main body panel 72 with a generally transparent front cover 74 hingedly and resiliently secured thereto at 76 in a well known manner to define between the rear surface of the cover 74 and the front surface of the main body panel 72 a pocket 73 normally used to receive paper labels or the like for display. However, as seen in FIG. 2, with the instant invention, the pocket 73 is used to receive the support element 32 of the support section 30 of the sign holder 10, with the upper portions of the cover 74 of the label holder 70 engaged in the pocket 33 at the top of the support section 30 of the sign holder 10. In this manner, the sign holder 10 is carried by the label holder 70 and can be positioned at any point along the length of the label holder to display a sign 50 providing special information regarding the merchandise (not shown) carried on the shelf surface 62 thereabove.

Although the sign holder 70 is shown as secured to the front edge 64 of the shelf 60 by adhesive 78 or the like, and a rearwardly directed flange 79 is shown on the bottom edge of the label holder 70 to engage a flange (not shown) on the bottom of the front lip 64 of the shelf 60, it is to be understood that the label holder 70 can be of any conventional form and can be attached to a shelf having a C-channel or one devoid of a C-channel in any conventional manner. Regardless of such details, the basic elements of such label holders comprise a main body panel hingedly secured at its lower edge to a transparent cover member to enable the cover member to be tipped forwardly, usually for the reception of a label but, in this instance, for the reception of the support element 32 of the support section 30 of the sign holder 10.

While the support element 32 of the support section 30 of the sign holder 10 is securely held in the label holder 70, the sign holder section 20 can be flexed slightly if its lower edge is engaged by a consumer reaching toward a product on a lower shelf (not shown), or removing such a product from the shelf.

Figure 3:
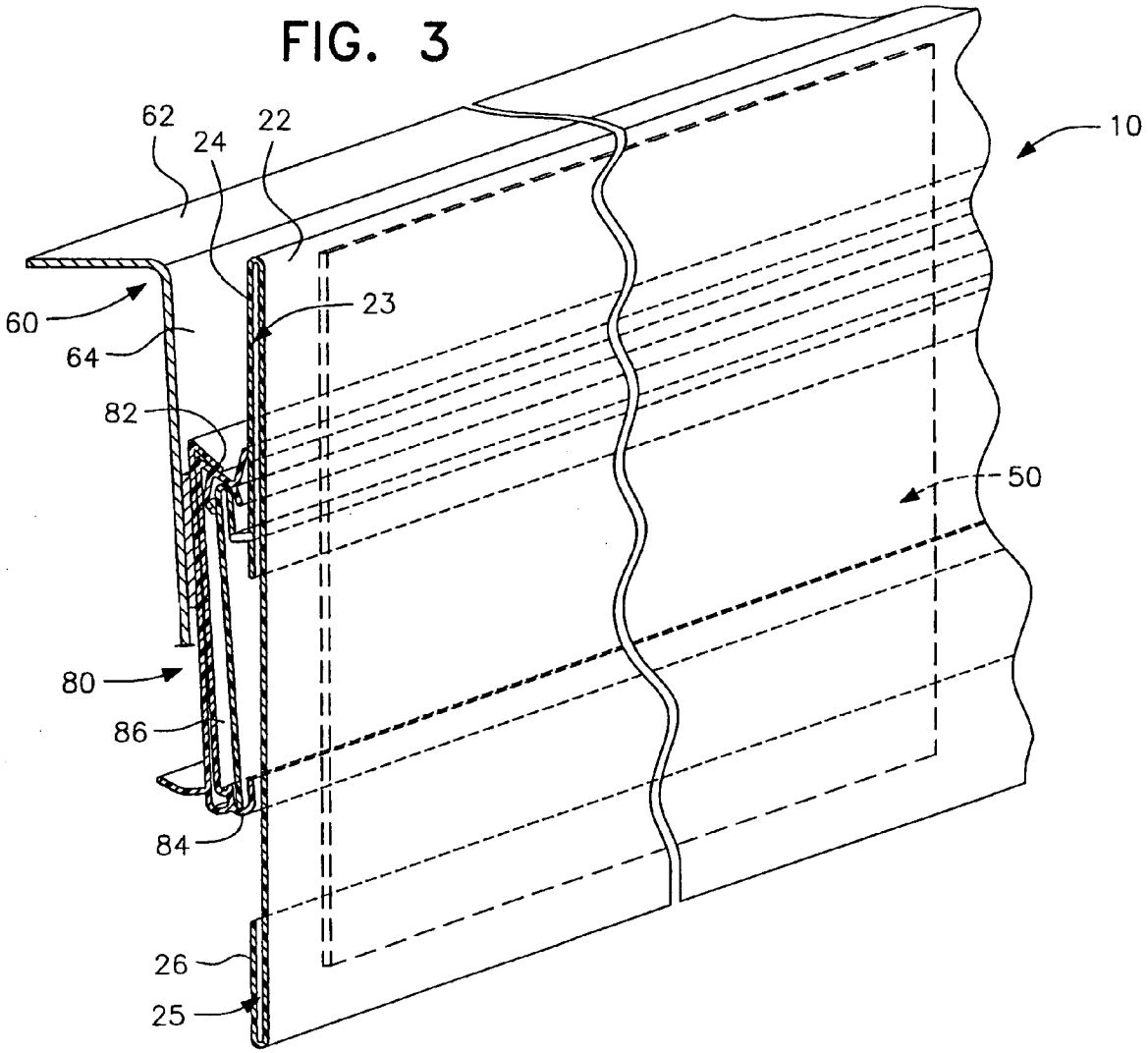
FIG. 3 is a cross-sectional perspective view of the sign holder of FIG. 1 carried by the sign holder portions of a combination label/sign holder of the type seen in the '112 patent fixed to the front lip of a merchandise shelf.

A unique aspect of the sign holder 10 of this invention is illustrated in FIG. 3 where it will be seen that the support element 32 of the support section 30 is of sufficient length to enable the same to be engaged in a C-channel integrally formed with the front lip of a merchandise shelf (not shown) or the sign holder portion of a combination label/sign holder 80 such as seen in the '112 patent. For illustrative purposes, in FIG. 3, the curved upper edge of the support element 32 of the support section 30 of the sign holder 10 is seen as engaged in an upper sign holder-receiving pocket defined by an upper sign holder receiving lip member 82 and the cover member 86 of the label/sign holder 80, and the lower edge of the support element 32 is engaged in a lower sign holder-receiving pocket defined by a lower sign holder-receiving lip member 84. Obviously, the support section 30 of the sign holder 10 of this invention can be similarly engaged in the upper and lower lips of a conventional C-channel on the front flange or lip of a shelf (not shown).

Of significance is the extended nature of the support element 32 of the support section 30 of the sign holder 10 of this invention which is of a length enabling its extremities to be engaged in the upper and lower lips of a standard C-channel or the sign holder elements formed on a combination label/sign holder such as seen in the '112 patent. Prior art devices of this nature have generally had a relatively short clip element for engagement over the cover of a label holder in the manner seen in FIG. 2, but failed to include a support element sufficient in length to enable the support section of the sign holder to be universally carried either in the pocket of a label holder or in a C-channel or a C-channel-like sign holder portion of a combination label/sign holder such as seen in the '112 patent.

While the exact dimensions of any of the sections of a sign holder according to this invention can be varied at will, it is important for the support element of the support section to be elongated as illustrated. For example, in a preferred embodiment, which is not to be limiting on the instant inventive concepts, the support element 32 is at least about five times the length of the reverted lip 34 of the support section 30. In addition to the significant versatility afforded by this unique design of the support section 30 of the sign holder 10 of this invention, the elongated support element 32 provides improved contact within the pocket 73 of a label holder such as seen at 70 in FIG. 2, minimizing the possibility of disengagement which can result from the use of a resiliently supported, relatively short clip to secure the sign holder to the cover member of a label holder such as is currently available in the prior art.

As will be recognized by those of ordinary skill in this art, the sign holder 10 of this invention, or a modified embodiment thereof substituting a different design for the sign holder section, can be carried by a label holder of almost any configuration as seen in the aforementioned label holder patents, and can also be carried by substantially any form of C-channel or a combination label/sign holder incorporating C-channel-like lip members, while holding the sign holder section in a secure manner, permitting the same to be moved slightly in the event of accidental or intentional engagement of a lower or upper portion thereof without disengagement. Production of a sign holder according to this invention is simple, using conventional multi-polymer extrusion techniques, is relatively inexpensive, provides a strong and secure device capable of protecting a sign and easy to install, regardless of the surface or element to which it is to be attached.

The foregoing descriptions and drawings should be considered as illustrative only of the principles of the invention. As noted, the invention may be configured in a variety of shapes and sizes and is not limited by the dimensions of the preferred embodiment. Numerous applications of the present invention will readily occur to those skilled in the art. Therefore, it is not desired to limit the invention to the preferred embodiments or the exact construction and operation shown and described. Rather, all suitable modifications and equivalents may be resorted to falling within the scope of the invention.

I claim:

1. A sign holder for a merchandise display shelf having a generally horizontally extending shelf member for receiving and supporting merchandise to be displayed and a downwardly depending lip member, said sign holder including a sign-receiving element and a mounting element mountable to said shelf member, and a resilient bead of flexible material interconnecting said sign-receiving element and said mounting element of said sign holder wherein said mounting element including a planar mounting panel including a rear face, a front face, an upper edge and a lower edge, and a planar reverted element having a front face, a rear face, an upper edge, and a lower edge, said upper edge of said reverted element being interconnected with said upper edge of said mounting panel by a U-shaped bight portion, said rear face of said reverted element extending in spaced relation to said front face of said mounting panel, the height of said mounting panel between said upper and lower edges of said mounting panel being a multiple of the height of said reverted element between said upper and lower edges of said reverted element;

said sign-receiving element comprising a transparent body panel having a front face, a rear face, and upper and lower spaced edge portions, a flap extending behind, and in spaced parallel relation, to said rear face of said body panel from each of said upper and lower body panel edge portions, said flaps each comprising front and rear faces, a terminal free edge portion and a bight portion integrally connecting said flap to said body panel at a respective body panel edge portion, said front face of each of said flaps together with said rear face of said body panel defining opposing, aligned, upper and lower sign-receiving channels; and said resilient bead of flexible material being connected between said rear face of said upper flap of said sign-receiving element and said front face of said reverted element of said mounting element to enable said sign-receiving element to move relative to said mounting element upon impact.

2. The sign holder as claimed in claim 1, wherein said body panel of said sign holder has a vertically extending height between said bight portions with a mid-point, and said flexible bead is connected to said upper flap at a point above said mid-point of said body panel.

* * * * *